US012669034B1

(12) United States Patent
Gundersen

(10) Patent No.: US 12,669,034 B1
(45) Date of Patent: Jun. 30, 2026

(54) DOWNHOLE SHOE TRACK TOOL, METHOD, AND SYSTEM

(71) Applicant: Baker Hughes Oilfield Operations LLC, Houston, TX (US)

(72) Inventor: Anders Gundersen, Houston, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 19/203,471

(22) Filed: May 9, 2025

(51) Int. Cl.
*E21B 41/00* (2006.01)
*E21B 34/08* (2006.01)
*E21B 43/00* (2006.01)

(52) U.S. Cl.
CPC ..... *E21B 41/00* (2013.01); *E21B 34/08* (2013.01)

(58) Field of Classification Search
CPC ..... E21B 41/00; E21B 34/08; E21B 43/00
USPC ..... 166/373, 265, 205
See application file for complete search history.

(56) References Cited

U.S. PATENT DOCUMENTS 3,006,415 A * 10/1961 Burns et al. ..... E21B 33/16 166/208
3,153,451 A * 10/1964 Chancellor ..... E21B 43/04 166/51
3,489,221 A * 1/1970 Holbert, Jr. ..... E21B 43/101 166/290
4,442,894 A 4/1984 Callihan et al.
4,706,747 A * 11/1987 Schneider ..... E21B 23/10 166/153
4,893,684 A * 1/1990 Alexander ..... E21B 21/00 175/324
4,979,562 A * 12/1990 Langer ..... E21B 21/10 166/156
5,390,736 A * 2/1995 Budde ..... E21B 21/10 166/156
6,079,496 A 6/2000 Hirth
6,634,428 B2 10/2003 Krauss et al.
9,719,322 B2 8/2017 Goebel
10,125,572 B2 11/2018 Wood et al.
10,260,306 B1 4/2019 Beckett et al.
11,459,874 B1 10/2022 Stair et al.
12,091,966 B1 9/2024 Stair et al.
2004/0251023 A1* 12/2004 Pluchek ..... E21B 27/005 166/205

(Continued)

OTHER PUBLICATIONS

Champeaux et al., "Qualification and Deployment of Float Equipment as in Independent Mechanical Barrier in Unconventional Wells"; SPE Paper No. 201264-MS; Oct. 21, 2020; 16 pages.

(Continued)

*Primary Examiner* — Nicole Coy
*Assistant Examiner* — Douglas S Wood
(74) *Attorney, Agent, or Firm* — Baker Hughes Company

(57) ABSTRACT

A downhole shoe track tool, including a housing, a wiper plug landing profile disposed in the housing, a check valve disposed in the housing, and a surge suppressor configured to flow fluid axially, the suppressor disposed in the housing. A method for protecting a formation from hydraulic shock including applying pressure to the tool, the pressure resulting in surge, and suppressing the surge in the surge suppressor. A wellbore system, including a borehole in a subsurface formation, a string in the borehole, and a downhole shoe track tool disposed within or as a part of the string.

18 Claims, 5 Drawing Sheets

(56) References Cited

U.S. PATENT DOCUMENTS

2013/0112410 A1* 5/2013 Szarka ..... E21B 33/165
166/135

OTHER PUBLICATIONS

Gunderson, et al.; "Intentional Wet Shoetrack Completions for Unconventional Oil and Gas Resources: Methods and Techniques"; SPE-213081-MS; Oklahoma City Oil and Gas Symposium; 2023; 48 pages.
Hord et al., "A Cost-Effective Alternative Method of Deploying Perforating Devices in High-Angle Wells"; SPE Paper No. IADC 140304; Mar. 1, 2011; 12 pages.
Rogers et al., "New Equipment Designs Enable Swellable Technology in Cementless Completions"; IADC/SPE Drilling Conference; Mar. 4, 2008.
Weatherford Mechanical Ball Seat; Liner Systems; www.weatherford.com; 2 pages.

* cited by examiner

DOWNHOLE SHOE TRACK TOOL, METHOD, AND SYSTEM

BACKGROUND

In the resource recovery and fluid sequestration industries a phenomenon known colloquially as "surge" can be a significant problem. Surge is essentially a tube wave or water hammer that at times can damage tools in a borehole or the formation surrounding the borehole. Damage to tools of these is detrimental to borehole operations and can be costly for a number of reasons. Damage to the formation often causes fluid losses and hence is expensive and deleterious to the well. Accordingly, the art will well appreciate innovations that reduce the effects of surge on the formation.

SUMMARY

An embodiment of a downhole shoe track tool, including a housing, a wiper plug landing profile disposed in the housing, a check valve disposed in the housing, and a surge suppressor configured to flow fluid axially, the suppressor disposed in the housing.

An embodiment of a method for protecting a formation from hydraulic shock including applying pressure to the tool, the pressure resulting in surge, and suppressing the surge in the surge suppressor.

An embodiment of a wellbore system, including a borehole in a subsurface formation, a string in the borehole, and a downhole shoe track tool disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
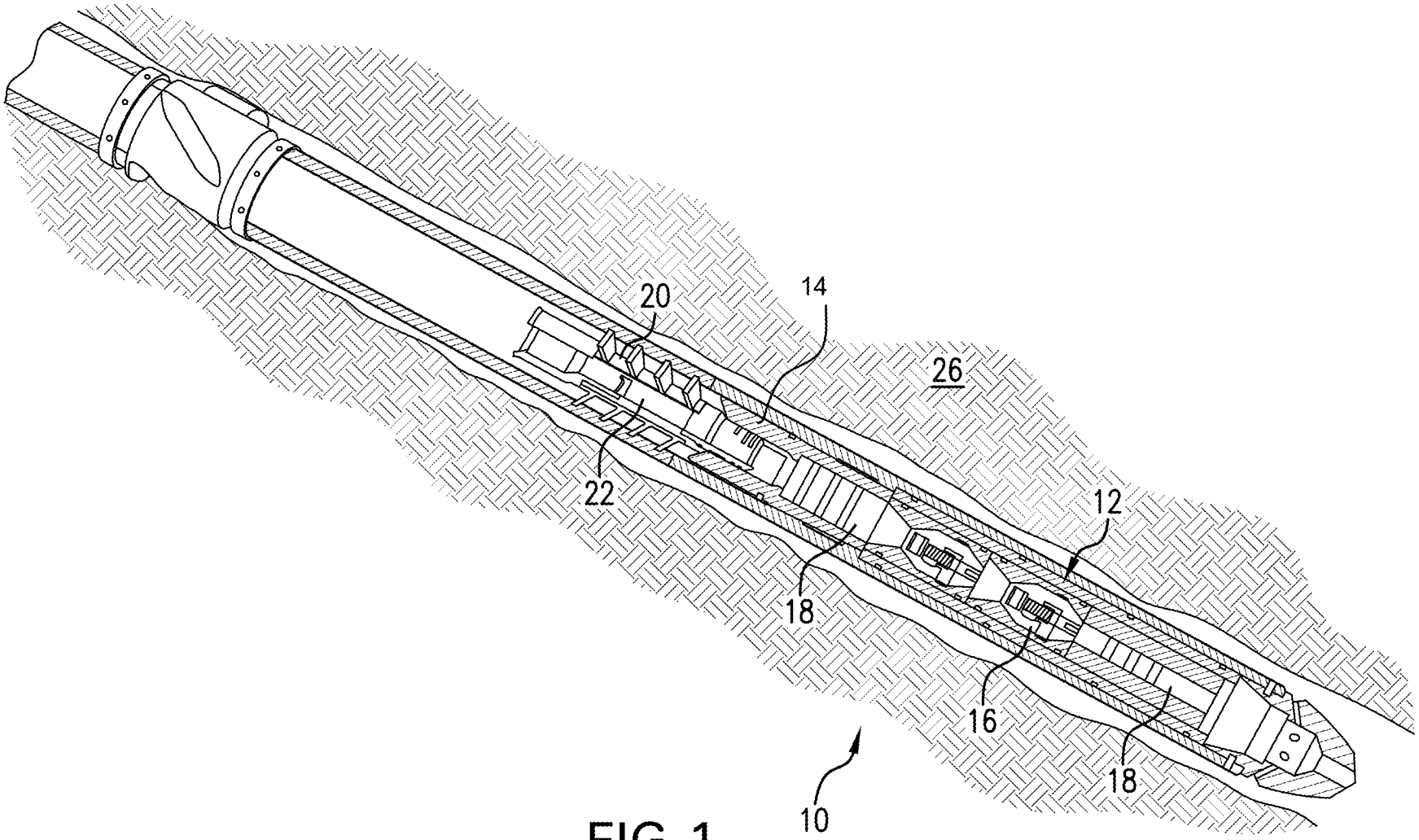
FIG. 1 is a perspective partial section view of a downhole shoe track tool with suppressor as disclosed herein.

Referring to FIG. 1, a downhole shoe track tool 10 is illustrated. Tool 10 includes a housing 12 that is operatively connected with a wiper plug landing profile 14, a check valve 16, and a surge suppressor 18 (which may be upstream of the check valve 16, downstream of the check valve 16 or both). The housing 12 may be configured as a single housing in which each of the stated components are mounted or may be separate structures that are fixedly attached (e.g. by threads, for example) to one another to create a collective housing. It will be appreciated that wiper plug landing profiles 14 are known and that check valves 16 are associated with float collars and float shoes in traditional shoe track tools. Commonly several check valves are included. Accordingly, there is no need to specifically address these components but rather to address the shoe track 10 as described herein that includes a suppressor 18 (upstream or downstream of the check valve 16). The shoe track 10 effectively and reliably addresses the effect of water hammer on the formation by suppressing the tube wave before it impacts the formation 26 during conditions that create a tube wave. One example of the formation of a tube wave is when a wiper plug 20 is landed on the wiper plug landing profile 14, whereafter pressure builds behind (uphole of) the wiper plug 20 until a rupture disk 22 in the wiper plug 20 ruptures thereby suddenly passing a high pressure wave in the downstream direction. In a traditional shoe track, the pressure wave just described is propagated through the check valve 16 and into the formation 26, possibly causing damage to the formation 26 and/or the check valve 16. Damage to the formation can have a variety of known forms including the potential significant loss of drilling fluids to the formation, which is costly. With regard to the check valve 16, the tube wave can cause a failure may prevent the check valve from functioning as designed, i.e., allowing flow in one direction but preventing flow in the opposite direction.

Figure 2:
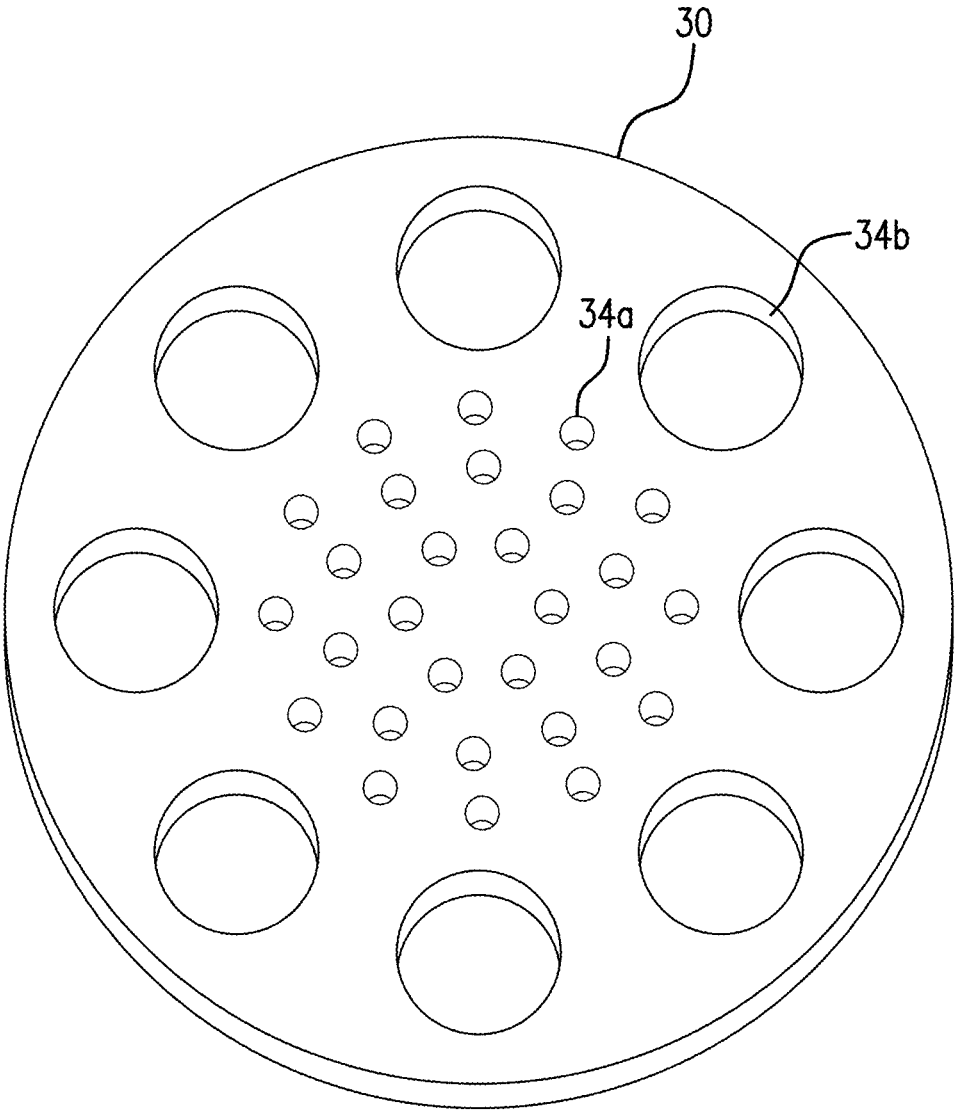
FIG. 2 is a view of an orthogonal baffle disclosed herein.

Focusing upon the suppressor 18, as noted it may be placed upstream or downstream of the check valve 16 with substantially the same result, with regard to the formation. It is noted however, that if the suppressor 18 is only positioned downstream of the check valve 16, the check valve 16 will not be protected. The suppressor 18 absorbs energy from the tube wave, thereby removing the detrimental effects thereof on structures downstream of the suppressor 18, such as the formation 26 and/or the check valve 16. It should be understood that any tool or geology downstream of the suppressor will be afforded at least some protection from damage due to a tube wave, assuming the downstream tool or geology is at least in some way susceptible to damage from a tube wave. Embodiments of the suppressor 18 employ one or more orthogonal baffles 30 and/or angular baffles 32 therein that alter the propagation patterns of the tube wave thereby attenuating the same. It is to be appreciated that where more than one baffle is employed, it may be a plurality of the same type of baffle, or it may include different types and/or different configurations of baffles. Illustrated in FIG. 1 (in either suppressor 18) are orthogonal baffles 30. These baffles 30 are essentially disk members (see FIG. 2). Three orthogonal baffles 30 are illustrated in each suppressor 18 but more or fewer are contemplated. In embodiments, referring to FIG. 2, orthogonal baffles 30 include a number of openings 34 therein. The openings 34 may be of the same size or may be of different sizes. Particularly, baffle 30 is configured to interrupt flow in some parts of the flow stream impacting the baffle while allowing others to flow through. The total area for flow versus where the baffle 30 is solid and prevents flow is adjustable for the particular use during the manufacturing stage so that overall flow rate at normal flow conditions is not significantly impeded but if a tube wave had been generated, that wave would be at least partially interrupted by the nonflow areas of the baffle 30. The nonflowing areas of the baffle 30 must either reflect or redirect the tube wave, thereby attenuating the same. For example, without intending limitation, in one embodiment a plurality of relatively smaller openings 34*a* are positioned toward a central area of the baffle 30 while relatively larger openings 34*b* are positioned radially outwardly of the relatively smaller openings 34*a*. In one embodiment, where the outer diameter of the tubular of which tool 10 is a part is 7.625 inches, the relatively smaller openings 34*a* may exhibit a diametrical dimension of about 0.2 inches while the relatively larger openings 34*b* exhibit a diametrical dimension of about 1.2 inches. The relatively smaller holes 34*a* are maintained at a diameter of about 0.2 inches regardless of ultimate tubing size to maximize attenuation while still tending to avoid packing with debris. In another embodiment, that is illustrative of the foregoing point, where the outer diameter of the tubular is 4.5 inches, the relatively smaller openings 34*a* still exhibit a diametrical dimension of about _0.2 inches_(same relatively smaller opening size even with a smaller diameter tubular for the same reason . . . reduced potential for debris packing) while the relatively larger openings 34*b* for this embodiment might exhibit a diametrical dimension of about 0.6 inches. It is also to be appreciated that although circular holes are illustrated, holes may be of any geometry. The openings in a baffle 30 work together to suppress the tube wave thereby reducing its energy prior to reaching the formation.

Figure 3:
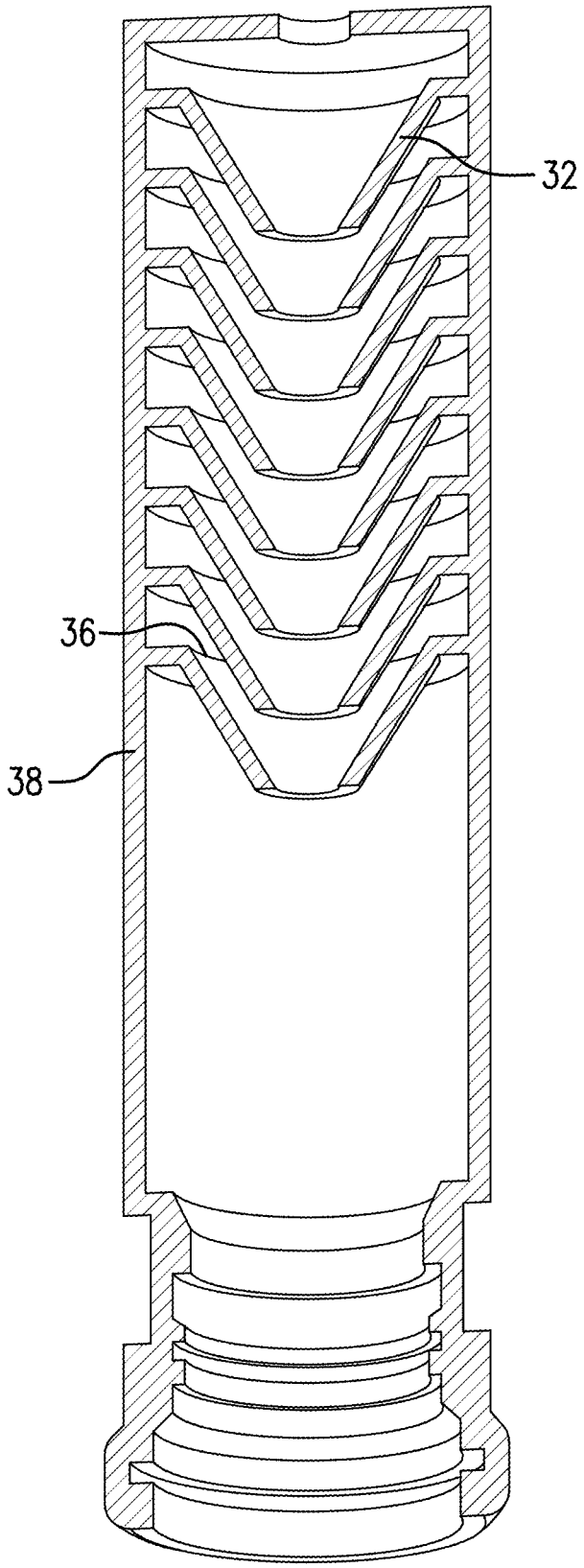
FIG. 3 is a section view of a suppressor disclosed herein.
Figure 4:
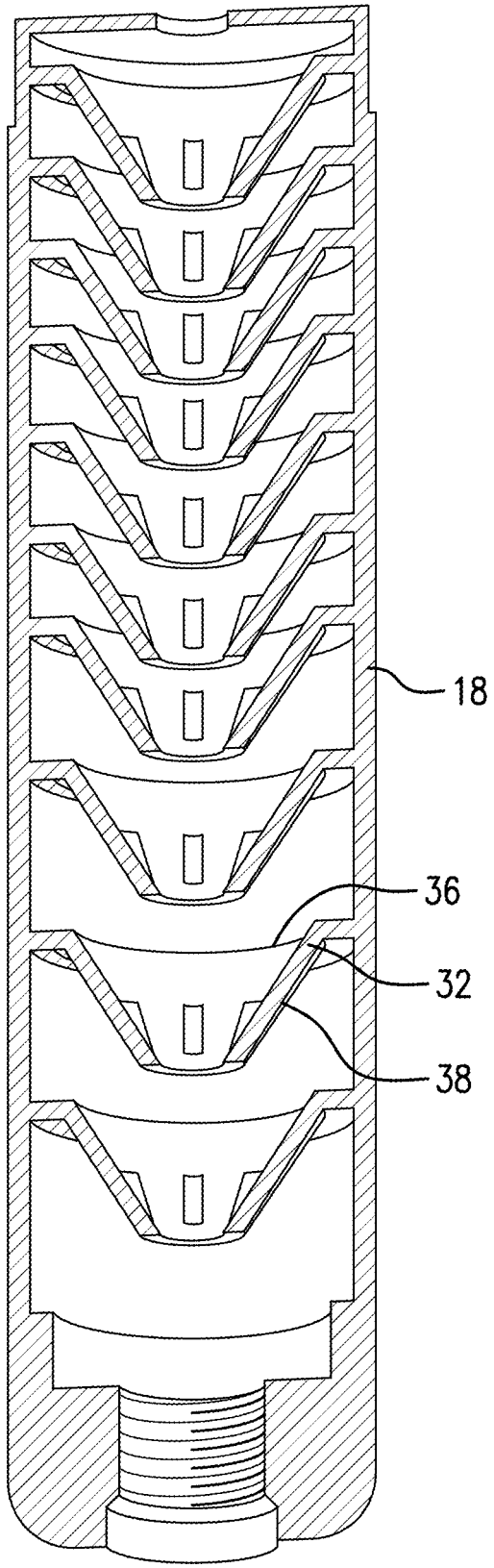
FIG. 4 is a section view of an alternate suppressor disclosed herein.
Figure 5:
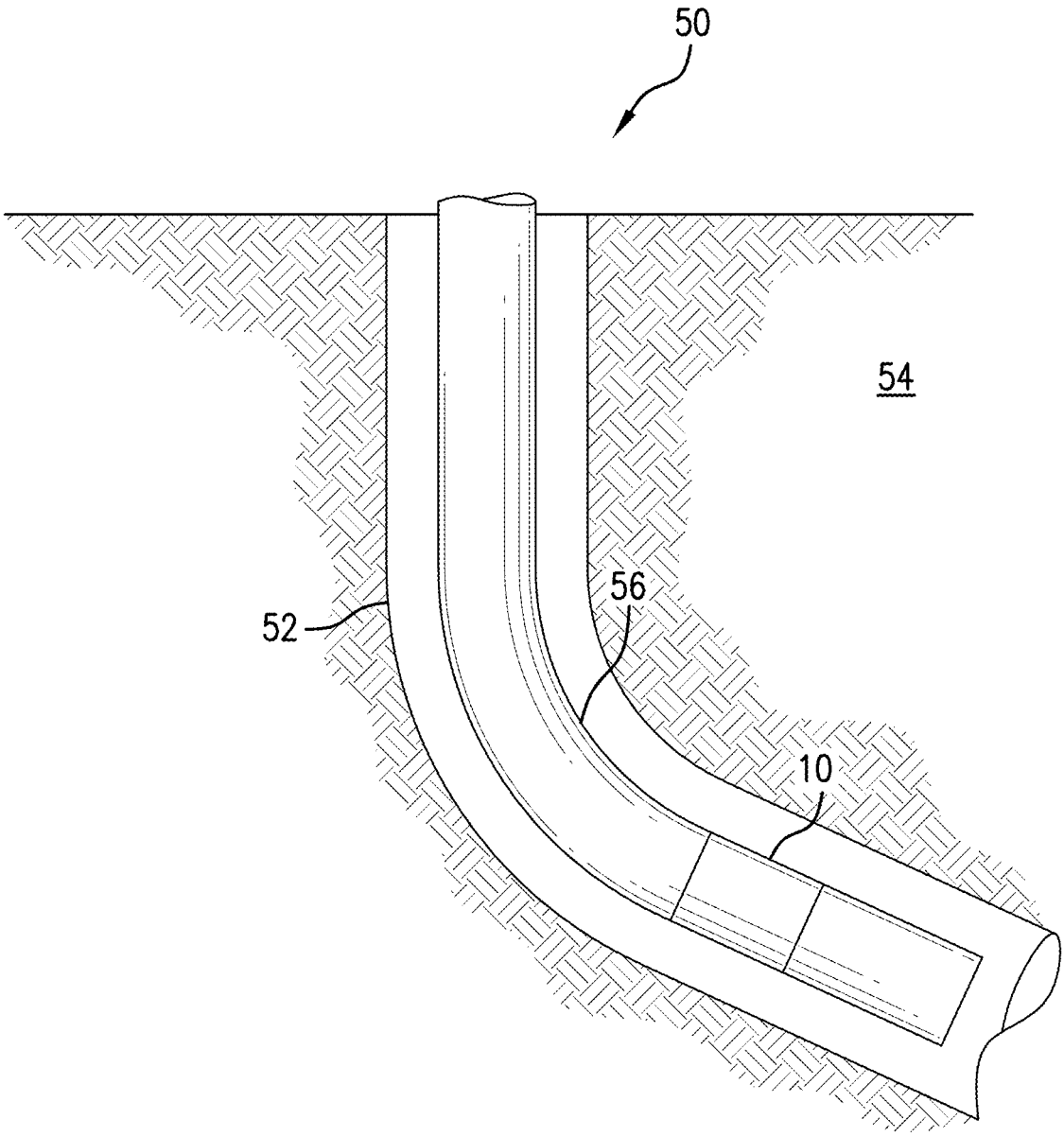
FIG. 5 is a view of a borehole system including downhole shoe track tool with suppressor as disclosed herein.

Alternatively, or additionally, baffles 32, referring to FIGS. 3 and 4, employ angled faces to reflect energy of the tube wave back into itself to attenuate the same. Specifically, each baffle 32 includes an upstream surface 36 that is disposed at an angle relative to an axial extent of the suppressor 18. The angle, in one embodiment, is from about 30 degrees to about 90 degrees from the axial extent of the suppressor 18. In another embodiment, the angle is from about 45 degrees to about 60 degrees Referring to FIG. 5, a wellbore system 50 is illustrated. The system 50 comprises a borehole 52 in a subsurface formation 54. A string 56 is disposed within the borehole 52. A downhole shoe track tool 10 as disclosed herein is disposed within or as a part of the string 56.

Set forth below are some embodiments of the foregoing disclosure:

Embodiment 1: A downhole shoe track tool, including a housing, a wiper plug landing profile disposed in the housing, a check valve disposed in the housing, and a surge suppressor configured to flow fluid axially, the suppressor disposed in the housing.

Embodiment 2: The tool as in any prior embodiment, wherein the suppressor includes a baffle disposed therein.

Embodiment 3: The tool as in any prior embodiment, wherein the baffle includes an upstream surface that is disposed at an angle relative to an axial extent of the suppressor.

Embodiment 4: The tool as in any prior embodiment, wherein the angle is in a range of from about 30 degrees to about 90 degrees.

Embodiment 5: The tool as in any prior embodiment, wherein the angle is in a range of from about 45 degrees to about 60 degrees.

Embodiment 6: The tool as in any prior embodiment, wherein the baffle is frustoconical in shape.

Embodiment 7: The tool as in any prior embodiment, wherein the frustoconical shape points in the downstream direction.

Embodiment 8: The tool as in any prior embodiment, wherein the surge suppressor includes a plurality of baffles.

Embodiment 9: The tool as in any prior embodiment, wherein the baffle is orthogonally disposed in the housing.

Embodiment 10: The tool as in any prior embodiment, wherein the baffle includes through bores therein.

Embodiment 11: The tool as in any prior embodiment, wherein the through bores include at least one through bore with a first area and at least one other through bore with a different area.

Embodiment 12: The tool as in any prior embodiment, wherein the through bores are arranged in the baffle with relatively smaller area through bores centrally located and relatively larger area flow bores located radially outwardly of the relatively smaller through bores.

Embodiment 13: The tool as in any prior embodiment, wherein the suppressor is disposed upstream of the check valve.

Embodiment 14: The tool as in any prior embodiment, wherein the suppressor is disposed downstream of the check valve.

Embodiment 15: The tool as in any prior embodiment, wherein the check valve is a plurality of check valves.

Embodiment 16: A method for protecting a formation from hydraulic shock including applying pressure to the tool as in any prior embodiment, the pressure resulting in surge, and suppressing the surge in the surge suppressor.

Embodiment 17: The method as in any prior embodiment, wherein the suppressing is by reflecting portions of the pressure wave.

Embodiment 18: The method as in any prior embodiment, wherein the reflecting is angular relative to the axial extent of the suppressor.

Embodiment 19: A wellbore system, including a borehole in a subsurface formation, a string in the borehole, and a downhole shoe track tool as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole shoe track tool, comprising:

a housing;

a wiper plug landing profile disposed in the housing;

a check valve disposed in the housing; and a surge suppressor configured to flow fluid axially, the suppressor disposed in the housing; and further including a baffle disposed within the suppressor.

2. The tool as claimed in claim 1, wherein the baffle includes an upstream surface that is disposed at an angle relative to an axial extent of the suppressor.

3. The tool as claimed in claim 2, wherein the angle is in a range of from about 30 degrees to about 90 degrees.

4. The tool as claimed in claim 2, wherein the angle is in a range of from about 45 degrees to about 60 degrees.

5. The tool as claimed in claim 1, wherein the baffle is frustoconical in shape.

6. The tool as claimed in claim 3, wherein the frustoconical shape points in the downstream direction.

7. The tool as claimed in claim 1, wherein the surge suppressor includes a plurality of baffles.

8. The tool as claimed in claim 1, wherein the baffle is orthogonally disposed in the housing.

9. The tool as claimed in claim 8, wherein the baffle includes through bores therein.

10. The tool as claimed in claim 9, wherein the through bores include at least one through bore with a first area and at least one other through bore with a different area.

11. The tool as claimed in claim 8, wherein the through bores are arranged in the baffle with relatively smaller area through bores centrally located and relatively larger area flow bores located radially outwardly of the relatively smaller through bores.

12. The tool as claimed in claim 1, wherein the suppressor is disposed upstream of the check valve.

13. The tool as claimed in claim 1, wherein the suppressor is disposed downstream of the check valve.

14. The tool as claimed in claim 1, wherein the check valve is a plurality of check valves.

15. A method for protecting a formation from hydraulic shock comprising:

applying pressure to the tool as claimed in claim 1, the pressure resulting in surge; and suppressing the surge in the surge suppressor.

16. The method as claimed in claim 15, wherein the suppressing is by reflecting or redirecting portions of the pressure wave.

17. The method as claimed in claim 16, wherein the reflecting is angular relative to the axial extent of the suppressor.

18. A borehole system, comprising:

a borehole in a subsurface formation;

a string in the borehole; and a downhole shoe track tool as claimed in claim 1 disposed within or as a part of the string.

* * * * *